United States Patent [19]

Eisenbach

[11] 3,982,876

[45] Sept. 28, 1976

[54] APPARATUS FOR MAKING PLATE ELEMENTS

[75] Inventor: Kurt Eisenbach, Bonn-Bad Godesberg, Germany

[73] Assignee: Rheinische Chamotte und Dinas-Werke, Bonn-Bad Godesberg, Germany

[22] Filed: Jan. 9, 1975

[21] Appl. No.: 539,737

Related U.S. Application Data

[62] Division of Ser. No. 472,897, May 23, 1974.

[30] Foreign Application Priority Data

May 25, 1973 Germany ..... 2326762

[52] U.S. Cl. ..... 425/501; 264/261; 425/510; 425/517; 425/126 R; 425/362; 425/371; 425/373

[51] Int. Cl.[2] ..... B29C 3/02; B29C 3/04

[58] Field of Search ..... 264/145, 261; 425/223, 425/363, 365, 337, 126 R, DIG. 200, DIG. 201, 517, 115, 126 R, 510, 371, 373

[56] References Cited

UNITED STATES PATENTS

| | | | |
|---|---|---|---|
| 1,315,166 | 9/1919 | Semashko | 29/211 |
| 3,138,843 | 6/1964 | Gory | 425/126 X |
| 3,359,354 | 12/1967 | Johnson | 264/261 X |
| 3,426,388 | 2/1969 | Prohaska | 425/362 X |
| 3,756,760 | 9/1973 | McBride | 425/363 |
| 3,761,209 | 9/1973 | Hanton | 425/371 X |
| 3,770,863 | 11/1973 | Elgenstierna | 264/261 |
| 3,839,519 | 10/1974 | Weiner | 264/261 X |
| 3,870,583 | 3/1975 | Gidge | 425/362 X |

*Primary Examiner*—Robert L. Spicer, Jr.
*Attorney, Agent, or Firm*—Michael J. Striker

[57] ABSTRACT

A conveyor belt is formed with depressions which are bounded by sealing edges, and tiles corresponding to the outline of the respective depressions are continuously admitted from above onto the belt and inserted into the depressions so as to be in sealing contact with the respective sealing edges. A layer of hardenable synthetic plastic material is then deposited on the belt over the tiles so that the latter are partially embedded in and united by the layer when the same hardens, thereby obtaining a unitary structure. Subsequently this structure is subdivided in plate elements of desired size.

10 Claims, 3 Drawing Figures

APPARATUS FOR MAKING PLATE ELEMENTS

This is a division of application Ser. No. 472,897 filed May 23, 1974.

BACKGROUND OF THE INVENTION

The present invention relates generally to the making of plate elements, and more particularly to the making of plate elements which are composed of a plurality of tiles embedded in a synthetic plastic backing. Specifically, the invention relates to an apparatus for carrying out the method.

There is an increasing demand for plate elements which are composed of tiles — usually relatively small ones — of ceramic or the like, and wherein a plurality of these tiles are united into a single element by being embedded in a backing of synthetic plastic material. Plate elements of this type are becoming more and more popular for cladding of walls, as coverings for floors in kitchens, bathrooms and the like, and must be mass-produced in order to be available at economically attractive cost. Moreover, it must be possible to produce these plate elements in any desired size, and particularly length, and a change-over from one length to another must be possible readily and without having to go to great length in readjusting the equipment that is used for manufacturing the plate elements.

The prior art has proposed to apply tiles of this type to a backing paper by means of an adhesive, and then to lay the thus produced plate element down wherever it is to be installed, with the backing paper remaining in place.

It is also being proposed to use a foil of synthetic plastic or other material, and to press the tiles onto this material so that grout lines exist between the individual tiles, which grout lines are then filled with a binder material, for instance a synthetic plastic resin or the like.

Another type of prior art construction involves applying the tiles adhesively to a netting which serves as the backing which holds them together.

All known prior-art approaches have various disadvantages. One of these is the fact that where a prior-art proposal suggests applying synthetic plastic material to the back of the tiles, this material invariably enters into the grout lines between adjacent ones of the tiles, and flows over unto the front side of the tiles, where it becomes visible as a stain forming an unsightly coating on the tiles, which must be laboriously removed before the finished plate element is ready for sale. Furthermore, it has been heretofore impossible to make plate elements which are composed of a plurality of tiles defining grout lines between themselves and which are partially embedded in a synthetic plastic backing, in any continuous manner. This means that an economically attractive manufacture of such plate elements has not heretofore been possible.

SUMMARY OF THE INVENTION

Accordingly, it is an object of the present invention to overcome the aforementioned disadvantages.

More particularly, it is an object of the invention to provide a novel apparatus making plate elements which are composed of a plurality of tiles embedded in a synthetic plastic backing.

Another object of the invention is to provide such an apparatus which permits the continuous production of plate elements of any desired dimensions.

An additional object of the invention is to provide such an apparatus which permits the manufacture of such plate elements which, once the synthetic plastic backing has been applied, require no further cleaning steps to remove any excess synthetic plastic material from them, in particular from the front side of the tiles.

In keeping with the above objects and with others which will become apparent hereafter, one feature of the invention resides in an apparatus making plate elements which are composed of a plurality of tiles embedded in a synthetic plastic backing, the apparatus advancing a conveyor belt formed with depressions which are bounded by sealing edges and continuously admitting tiles from above into the respective depressions so as to be in circumferential contact with the sealing edges. A layer of hardenable synthetic plastic material is thereupon deposited on the belt and over the tiles, so that the layer partially embeds and unites the tiles on the belt. The synthetic plastic material is thereupon hardened in order to obtain a unitary structure and the latter is subdivided into plate elements of desired size.

The sealing engagement of the sealing edges with the tiles which have been admitted into the respective depressions assures that the synthetic plastic material cannot penetrate into the depressions and creep around the edges of the tiles and to the front sides thereof, that is the sides which face inwardly of the depressions, while the tiles are being provided with the synthetic plastic backing.

It is advantageous if the individual operating steps, such as the supply of the tiles to the conveyor belt, the operation of the conveyor belt itself, the deposition of the layer of synthetic plastic material and the regulation of its thickness, and the subdividing of the structure into plate elements of desired size, are electronically controlled for instance by means of a known electronic program-control system.

The apparatus according to the present invention comprises a travelling conveyor belt having a plurality of depressions each of which is bounded by a sealing lip and adapted to accommodate a tile. A source of tiles is also provided, and a slide feeds tiles from the source into the depressions of the belt. Means is provided for depositing a layer of hardenable synthetic plastic material onto the belt so as to partially embed the tiles and unite them into a unitary structure upon hardening of the synthetic plastic material. Further, means is provided for subdividing the unitary structure into plate elements of desired size.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
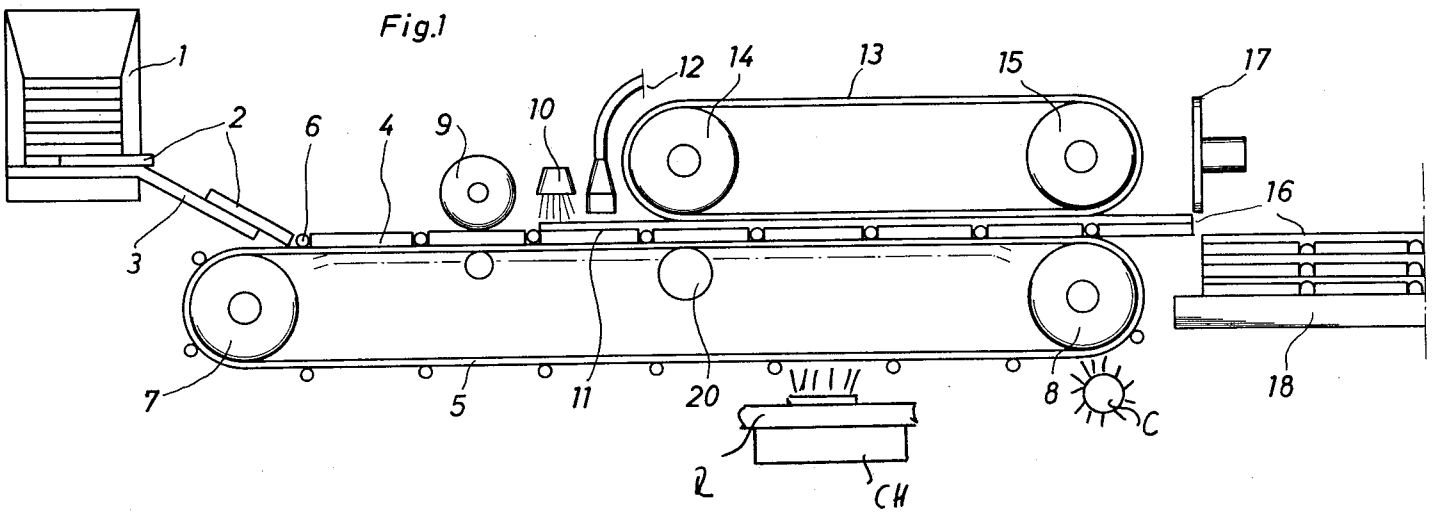
FIG. 1 is a somewhat diagrammatic side-elevational view illustrating an embodiment of the invention.
Figure 2:
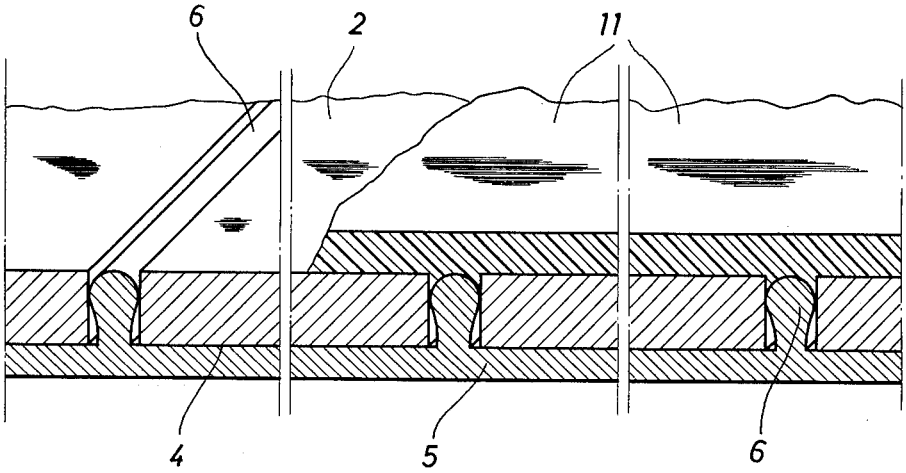
FIG. 2 is a fragmentary vertical sectional detail view, showing a detail of FIG. 1.

Referring firstly to the embodiment illustrated in FIGS. 1 and 2, it will be seen that reference numeral 1 identifies a source of tiles 2 which are usually of ceramic material and which are stacked in overlying relationship, as illustrated. These tiles 2 are withdrawn from the bottom of the stack in the source 1, in a manner which is not illustrated because it is known per se in the art, and move on a slide 3 is form of a continuous series of tiles onto the upper run of a travelling conveyor belt 5. The belt 5 should be understood to travel in clockwise direction, and the tiles 2 should be understood to become deposited on the belt 5 with their rear sides facing upwardly, that is their front sides which later in use will be exposed, facing downwardly.

The belt 5 is formed with a plurality of depressions 4 on its exposed surface as is also evident from FIG. 2, and each of the tiles 2 becomes deposited in one of the depressions 4. The belt 5 advances continuously, being trained about two reversing rollers 7 and 8 of which at least one, in this embodiment the roller 8 is driven in rotation. In known manner, the rollers 7 and 8, or at least one of them, may be so mounted that they can be shifted away from one another in order to tension the belt 5 should the latter become slack.

The depressions 4 are distributed over the width and length of the belt, 5, as is self-evident when it is considered that each finished plate element is to be composed of a plurality of the tiles 2. The depressions 4 are so located that grout-lines or gaps will remain between laterally adjacent ones of the tiles 2.

Each of the depressions 4 is bounded by a sealing lip 6 which may have the substantially tear-dropshaped configuration, as shown in FIG. 2, and which have the purpose of engaging the circumferential edges of the respective tiles in order to seal the interior of the respective depression 4 against the entry of synthetic plastic material which is applied to the backs of the tiles. The proper insertion and positioning of the tiles 2 in the respective depressions 4 is assured by a roller 9 which is mounted above the upper run of the conveyor belt 5 so that it can rotate and will force the tiles properly into the depressions 4 (if they are not already properly inserted) as they pass beneath it. The roller 9 may be mounted so that it can resiliently yield in upward direction, that is its shaft may be mounted in bearings which are spring-loaded and permit yielding of the roller 9 in upward direction to a slight extent.

A layer of synthetic plastic material, for instance polyvinylchloride or polyethylene, or another suitable synthetic plastic, is deposited in flowable state by an nozzle 10 which sprays or flows it onto the upper run of the belt 5, and more particularly onto the exposed upper side or reversed side of the tiles 2. The layer is identified with reference numeral 11 and is continuous, extending over the entire width of the belt 5 and being continuous in longitudinal direction.

It is known that when hardenable synthetic plastic resins undergo hardening they develop vapors; these vapors are removed by an exhauster 12. The hardening may be a natural hardening resulting from the cooling effect of the ambient atmosphere, or it may be aided by appropriate means known in the art, for instance the application of heat or of cooling fluids, depending upon whether a thermosetting or a thermoplastic resin is used.

When the layer 11 has hardened or substantially hardened, thus becoming united with the tiles 2 which are now partially embedded in it and reliably secured to it, it travels beneath an upper conveyor belt 13 which has a smooth surface and is mounted for travel about two reversing rollers 14 and 15. The belt 13 extends from a location substantially midway between the opposite ends of the run of the belt 5, that is from downstream of the nozzle 10 to the downstream end of the belt 5, as shown. A supporting table or supporting roller 20 is located beneath the upper run of the belt 5 and beneath the region where the roller 14 of the belt 13 is provided, so as to permit an adjustment of the gap between the table or roller 20 and the roller 14. In other words, the roller 14 and/or the table or roller 20, (a roller is shown) can be made height-adjustable so as to move toward or away from the other in order to control the thickness of the layer 11, which is not yet hardened at the time it travels beneath the roller 14, to such an extent as to make squeezing and smoothing-out of the upper surface of the layer 11 by the action of the roller 14 and the belt 13 possible.

The speed of travel of the belts 5 and/or 13 may be made independently adjustable, for instance by using variable speed drives for driving the driven rollers 8, 15, and by speeding up or slowing down one or the other or even both of the belts 5, 13, the thickness of the layer 11 can be varied, that is it can be increased or decreased.

Figure 3:
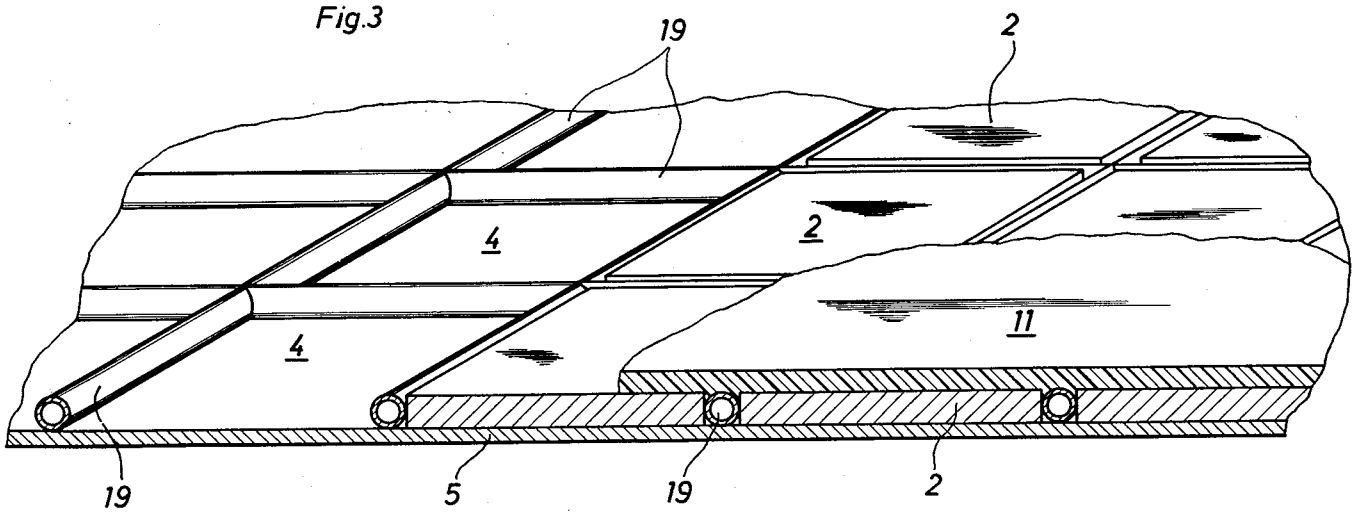
FIG. 3 is a view analogous to FIG. 2, but illustrating a different embodiment of the invention.

FIG. 3 shows that in place of the solid cross section sealing lips 6 the belt 5 can instead be provided with hose-like sealing lips 19 which can be inflated by connecting them to a source of compressed gas just before they reach the nozzle 10 in order to sealingly engage the tiles 2, and which can be deflated by disconnecting them from the source of compressed gas when they reach the downstream ends of the conveyors 5, 13. In all other respects the embodiment of FIG. 3 corresponds to that of FIGS. 1 and 2.

Returning to FIGS. 1 and 2, it will be understood that the finished unitary structure composed of the hardened layer 11 and the tiles 2 which are embedded in it leaves the downstream ends of the conveyors 5, 13 and can now be subdivided in plate elements of desired size, for example by cutting or sawing through them by a rotary blade 17 which can also be shifted back and forth transversely of the elongation of the layer 11 and the embedded tiles. Thus, plate elements of desired length can be produced, which are identified with reference numeral 16 and which may be deposited on a support 18 to form a stack thereon which can then later be removed and transported away.

The lower run of the belt of the conveyor 5 may be treated to make it ready for accepting additional tiles 2 and repeating the aforementioned process, when the increments of the belt move from the lower run to the upper run. For this purpose, a cleaning brush C is provided, diagrammatically illustrated in form of a cylinder. This brush is provided with a direct drive. Downstream of the cleaning arrangement C there may be a release arrangement R, which is diagrammatically illustrated as a section of pipe from which a nozzle sprays a release agent against the belt, for instance a polytetrafluoroethylene or similar composition, which will subsequently make it easier to separate the tiles 2 and the layer 11 from the belt when they reach the downstream end of belt conveyor 5. A collecting chamber CH for collecting the superfluous release fluid is provided under the release arrangement R.

If desired, or necessary, the elements 16 can be preformed in their lateral regions with tongue-and-groove configurations by appropriately shaping the side edges of the belts 5 or 13.

It will be understood that each of the elements described above, or two or more together, may also find a useful application in other types of applications differing from the types described above.

While the invention has been illustrated and described as embodied in the making of plate elements, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore such adaptations should and are intended to be comprehended within the meaning and range of equivalence of the following claims.

What is claimed as new and desired to be protected by Letters Patent is set forth in the appended claims:

1. Apparatus for making plate elements composed of tiles partially embedded in a synthetic plastic material backing, comprising a travelling conveyor belt having a plurality of depressions each bounded by a sealing lip and adapted to accommodate a tile having a front and a rear major surface and a circumferential surface; a source of tiles; means for feeding tiles from said souce into said depressions so that the rear major surfaces of the tiles face away from said conveyor belt and said sealing lips sealingly contact the circumferential surfaces of the tiles and space the latter from one another; means for depositing a layer of hardenable synthetic plastic material over the rear major surfaces of the tiles accommodated in said depressions of said conveyor belt so as to partially penetrate between the tiles and thus partially embed the same and unite them into a unitary structure upon hardening of said synthetic plastic material to form said backing, said sealing lips preventing penetration of the synthetic plastic material to the front major surfaces of the tiles; and means for subdividing said unitary structure into plate elements of desired size, each incorporating a plurality of the tiles partially embedded in the hardened synthetic plastic material backing so that the front major surfaces of the tiles are exposed.

2. Apparatus as defined in claim 1, wherein said feeding means includes a slide extending between said source and said conveyor belt.

3. Apparatus as defined in claim 1; and further comprising a yieldably mounted roller above said belt and positioned so that tiles from said feeding means must pass beneath said roller to be urged by the same into said depressions.

4. Apparatus as defined in claim 1; and further comprising means for urging said tiles into the respective depressions.

5. Apparatus as defined in claim 1, wherein said tiles are introduced into said depressions on the upper stringer of said belt; and further comprising a smooth-surfaced additional conveyor belt above and juxtaposed with a downstream portion of said upper stringer.

6. Apparatus as defined in claim 5, wherein said additional conveyor belt extends to a downstream end of said upper stringer from a location substantially midway between the upstream and downstream ends of said upper stringer.

7. Apparatus as defined in claim 1, wherein said sealing lip is of substantially tear-drop shaped cross-section and sealingly engages the circumferential surface of the respective tile.

8. Apparatus as defined in claim 1, wherein said sealing lips are hollow and hose-like, and can be made to engage the respective tiles in response to admission of compressed gaseous fluid into the respective sealing lips.

9. Apparatus as defined in claim 8, wherein said conveyor belt has a downstream end; and wherein admission of said compressed gaseous fluid to said sealing lips is terminated as said lips approach said downstream end.

10. Apparatus as defined in claim 1, said belt having an upper stringer on which said layer is deposited over said tiles, and a lower return stringer; and further comprising means for cleaning and for spraying a release agent onto said lower return stringer.

* * * * *